US007787790B2

(12) United States Patent
Tsueda et al.

(10) Patent No.: US 7,787,790 B2
(45) Date of Patent: Aug. 31, 2010

(54) FIXING APPARATUS AND IMAGE FORMING APPARATUS

(75) Inventors: Yoshinori Tsueda, Fuji (JP); Satoshi Kinouchi, Tokyo (JP); Osamu Takagi, Chofu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/478,309

(22) Filed: Jun. 4, 2009

(65) Prior Publication Data

US 2009/0245844 A1 Oct. 1, 2009

Related U.S. Application Data

(62) Division of application No. 11/443,168, filed on May 31, 2006, now Pat. No. 7,558,499.

(51) Int. Cl.
*G03G 15/20* (2006.01)

(52) U.S. Cl. ..... 399/69

(58) Field of Classification Search ..... 399/69, 399/98, 328, 330, 335; 219/216
See application file for complete search history.

(56) References Cited

U.S. PATENT DOCUMENTS

| | | | |
|---|---|---|---|
| 6,643,491 | B2 | 11/2003 | Kinouchi et al. |
| 6,964,515 | B2 | 11/2005 | Asakura et al. |
| 7,062,187 | B2 | 6/2006 | Peng et al. |
| 7,106,985 | B2 | 9/2006 | Sone et al. |
| 2005/0205557 | A1 | 9/2005 | Sone et al. |
| 2005/0207774 | A1 | 9/2005 | Sone et al. |
| 2005/0226645 | A1 | 10/2005 | Sone et al. |
| 2006/0062585 | A1 | 3/2006 | Sone et al. |
| 2006/0062586 | A1 | 3/2006 | Sone et al. |

FOREIGN PATENT DOCUMENTS

| | | | |
|---|---|---|---|
| CN | 1680888 | A | 10/2005 |
| JP | 10-031390 | A | 2/1998 |

(Continued)

OTHER PUBLICATIONS

U.S. Appl. No. 11/080,943, filed Mar. 16, 2005, Sone et al.

(Continued)

*Primary Examiner*—Robert Beatty
(74) *Attorney, Agent, or Firm*—Foley & Lardner LLP

(57) ABSTRACT

A fixing apparatus of the present invention includes a heating roller 2 that is a cylindrical member having a center axis, a pressurizing roller 3 that exerts pressure on the heating roller 2, and a temperature detecting element 6 that detects the temperature of the heating roller 2. The outer peripheral surface of the heating roller 2 is induction heated on the basis of the temperature information detected by the temperature detecting element 6. The fixing apparatus thus utilizes induction heating. The present invention is characterized in that the temperature detecting element 6 is placed in an area located vertically below the center axis of the heating member 2 and vertically below the outer peripheral surface of the heating member. The temperature detecting element 6 is thus provided at a position where it is unlikely to suffer thermal convection from the heating roller 2.

19 Claims, 6 Drawing Sheets

FOREIGN PATENT DOCUMENTS

| | | | |
|---|---|---|---|
| JP | 2001-034109 | A | 2/2001 |
| JP | 2001-228746 | A | 8/2001 |
| JP | 2003-004536 | A | 1/2003 |
| JP | 2003-254828 | A | 9/2003 |
| JP | 2004-325637 | A | 11/2004 |

OTHER PUBLICATIONS

U.S. Appl. No. 11/082,198, filed Mar. 17, 2005, Sone et al.
U.S. Appl. No. 11/082,242, filed Mar. 17, 2005, Sone et al.

FIXING APPARATUS AND IMAGE FORMING APPARATUS

The present application is a divisional of U.S. application Ser. No. 11/443,168, filed May 31, 2006, the entire contents of which is incorporated herein by reference.

FIELD OF THE INVENTION

The present invention relates to a fixing apparatus that fixes a developer image on a sheet, and an image forming apparatus such as a copier or a printer in which the fixing apparatus is mounted.

BACKGROUND OF THE INVENTION

Image forming apparatuses utilizing digital techniques, for example, electronic copiers, have a fixing apparatus that fixes a thermally melted development image on a sheet under pressure.

The fixing apparatus comprises a heating roller that melts a developer, for example, toner, and a pressurizing roller that exerts a predetermined pressure on the heating roller. A predetermined contact width (nip width) is formed in a contact area (nip portion) between the heating roller and the pressurizing roller. A development image on a sheet melted by heat from the heating roller is fixed on a sheet passing through the nip portion, under pressure from the pressurizing roller. In recent years, an induction heating device has been utilized which forms a thin metallic conductive layer outside the heating roller and which heats the metallic conductive layer using induction heating.

A known method for the induction heating device uses a detection element that is brought into contact with the surface of the heating roller to detect the temperature of the surface. The method thus controls the induction heating of the heating roller on the basis of the detected temperature. However, this contact temperature detecting element may degrade the surface of the heating roller when sliding on it. This may disadvantageously reduce the lifetime of the heating roller. The degraded surface of the heating roller may also reduce the responsiveness of the temperature detecting element, which may thus incorrectly detect a target temperature.

A known technique uses a temperature detecting element that detects infrared radiation emitted by the heating roller to determine the temperature of the heating roller in a non-contact manner. This non-contact temperature detecting element condenses infrared radiation from the target via a condensing lens to detect the target temperature on the basis of the quantity of infrared radiation received. This enables the surface temperature to be detected without damaging the heating roller.

However, toner or paper dust flaying in the fixing apparatus may disadvantageously contaminate a lens of the temperature detecting element. The contaminated lens may reduce the quantity of infrared radiation received by the temperature detecting element. This may result in an error in the value detected by the temperature detecting element.

For example, an image forming apparatus is disclosed in Jpn. Pat. Appln. KOKAI Publication No. 2001-34109. This image forming apparatus measures variations in the output characteristics of thermopiles 203 and 204 with respect to variations in outputs from thermistors 205 and 206 that detect the self temperatures of the non-contact temperature detection sensors 39c and 39d. On the basis of these variations, the image forming apparatus detects contamination of the surface of the sensor to compensate for a detected temperature characteristic depending on the condition of the contamination.

Jpn. Pat. Appln. KOKAI Publication No. 2003-4536 discloses a fixing apparatus comprising a movable filter 4. The movable filter 4 is prepared free movement between a heated member 1 that is a temperature detection target and a detection surface 3a of a non contact temperature sensor 3 placed opposite the heated member 1, and allows infrared radiation to pass; the infrared radiation is emitted by the heated member 1.

Jpn. Pat. Appln. KOKAI Publication No. 10-31390 discloses an electrophotographic apparatus that controls the temperature of a heating roller 9 on the basis of a sensing output from a non-contact temperature sensor 14. In this apparatus, the non-contact temperature sensor 14 has self temperature sensing means for providing sensing outputs based on the difference between its self temperature and the temperature of a heating roller that is a target. When a sensing output from the self temperature detection means is defined as T0 and a self temperature output is defined as T1, the temperature T of the heating roller is controlled on the basis of its value, that is, on the basis of a multi-order equation of T1: $T=C(T1)+f(T1)\times T0+g(T1)\times T0^2+h(T1)\times T0^3+\ldots$ and a function expression of T1: C(T1), f(T1), g(T1), h(T1), . . . (example: $f(T1)=\text{constant } A+\alpha\times T1+\beta\times T1^2+\gamma\times T1^3+\ldots$) (constants A, $\alpha$, $\beta$, and $\gamma$ are real numbers other than 0).

BRIEF SUMMARY OF THE INVENTION

According to an aspect of the present invention, there is provided a fixing apparatus comprising:

a heating member which is a cylindrical member having a center axis, the heating member having an outer peripheral surface which is heated;

a temperature detecting member placed in an area located vertically below the center axis of the heating member and vertically below the outer peripheral surface of the heating member, the temperature detecting member including a detection surface which receives infrared radiation from the heating member, the temperature detecting member detecting the temperature of the outer peripheral surface of the heating member on the basis of the received infrared radiation; and a heating device which heats the heating member to a target temperature on the basis of the temperature detected by the temperature detecting member.

According to another aspect of the present invention, there is provided an image forming apparatus comprising:

an image carrier which electrostatically holds a development image;

a transfer device which transfers the development image from the image carrier to transfer media;

a heating member which is a cylindrical member having a center axis, the heating member having an outer peripheral surface which is heated;

a pressurizing member which exerts a predetermined pressure on the heating member to melt and contact the development image with the transfer media under pressure, the transfer media passing between the pressuring member and the heating member;

a temperature detecting member placed in an area located vertically below the center axis of the heating member and vertically below the outer peripheral surface of the heating member, the temperature detecting member including a detection surface which receives infrared radiation from the heating member, the temperature detecting member detecting the temperature of the outer peripheral surface of the heating member on the basis of the received infrared radiation;

a heating device which heats the heating member to a target temperature on the basis of the temperature detected by the temperature detecting member; and a control section connected to the image carrier, the transfer device, and the heating device to integrally control the image carrier, transfer device, and heating device.

According to a further aspect of the present invention, there is provided a fixing apparatus comprising:

a heating member which is a cylindrical member having a center axis, the heating member having an outer peripheral surface which is heated;

temperature detecting means placed in an area located vertically below the center axis of the heating member and vertically below the outer peripheral surface of the heating member, the temperature detecting means including a detection surface which receives infrared radiation from the heating member, the temperature detecting means detecting the temperature of the outer peripheral surface of the heating member on the basis of the received infrared radiation; and heating means for heating the heating member to a target temperature on the basis of the temperature detected by the temperature detecting member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described below in detail with reference to the drawings.

First Embodiment

Figure 1:
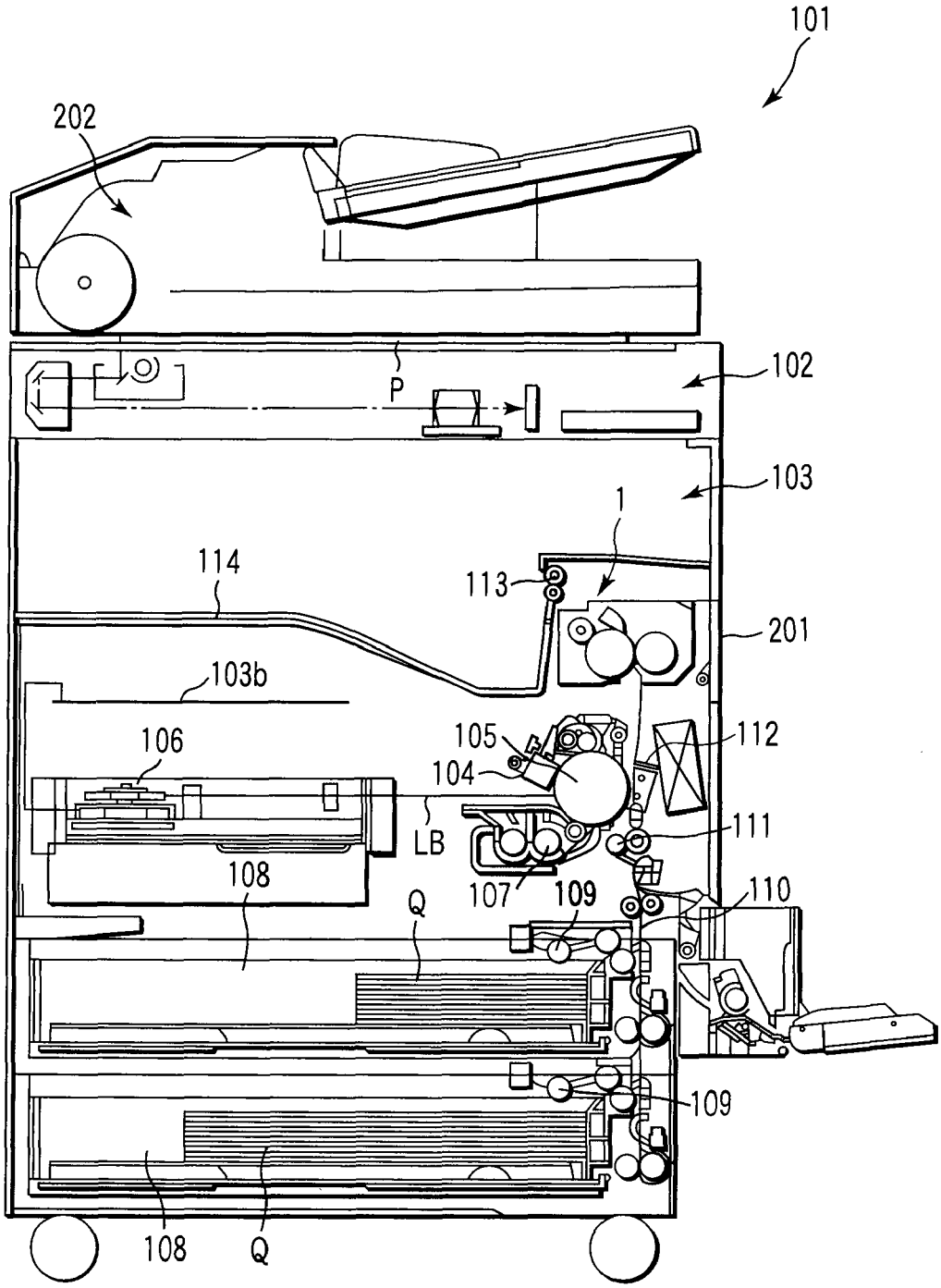
FIG. 1 is a schematic diagram showing an example of an image forming apparatus according to the present invention.

As shown in FIG. 1, an image forming apparatus (digital copying apparatus) 101 has an image reading device (scanner) 102 that reads an image from a read or copy target (document) P to generate an image signal, an image forming section 103 that forms an image on the basis of the image signal output by the scanner 102, and an outer cover 201 located in the outermost portion of the image forming apparatus or between devices or circuits described below. The scanner 102 is provided integrally with an auto document feeder (ADF) 202.

The image forming section 103 has a fixing apparatus 1, a charger 104, a photosensitive drum 105, an exposure device 106, a development device 107, a sheet cassette 108, a pickup roller 109, a conveying path 110, an aligning roller 111, a transfer device 112, a sheet discharging roller 113, and a sheet discharging tray 114.

The charger 104 charges the surface of the photosensitive drum 105 to a predetermined potential. The charger 104 may be a corona wire, a contact roller, or a contact blade.

The photosensitive drum (image carrier, image carrying means) 105 has a photosensitive member on its outer peripheral surface; the photosensitive member to which a predetermined potential is applied is irradiated with light to change the potential of an area irradiated with the light, and can hold the change in potential as an electrostatic image for a predetermined time. The photosensitive member may be shaped like a belt instead of a drum.

The exposure device 106 is located downstream of the charger 104 in the direction in which the photosensitive drum 105 is rotated. The exposure device 105 exposes an image signal supplied by the scanner 102 to a laser beam LB having a varying light intensity. The laser beam LB may have a predetermined light intensity corresponding to the density of the image or the like. The exposure device 106 may use LED instead of the laser.

The development device 107 is located downstream of the exposure device 106 in the direction in which the photosensitive drum 105 is rotated. The development device 107 houses a two-component developer consisting of a carrier and toner and supplies the developer (toner) to the surface of the photosensitive drum 105. This visualizes a latent image on the surface of the photosensitive drum 105 to form a toner image. The developer may be a one-component developer consisting only of toner.

The sheet cassette 108 accommodates sheets Q, and the pickup roller 109 picks up a sheet. The picked-up sheet Q is conveyed through the conveying path 110 to the aligning roller 111.

The aligning roller 111 rotates at a predetermined timing to convey the sheet Q to a transfer position in order to align the sheet Q with a toner image formed on the photosensitive drum 105.

The transfer device 112 applies a predetermined potential to the sheet Q to transfer the toner image on the photosensitive drum 105 to the sheet Q. The transfer device 112 may be a corona wire, a contact roller, or a contact blade.

The fixing apparatus 1 applies predetermined heat and pressure to the sheet Q holding the toner image, to melt and fix the toner image on the sheet Q.

The sheet discharging roller 113 conveys the sheet Q discharged by the fixing apparatus 1, to the sheet discharging tray 114.

Figure 2:
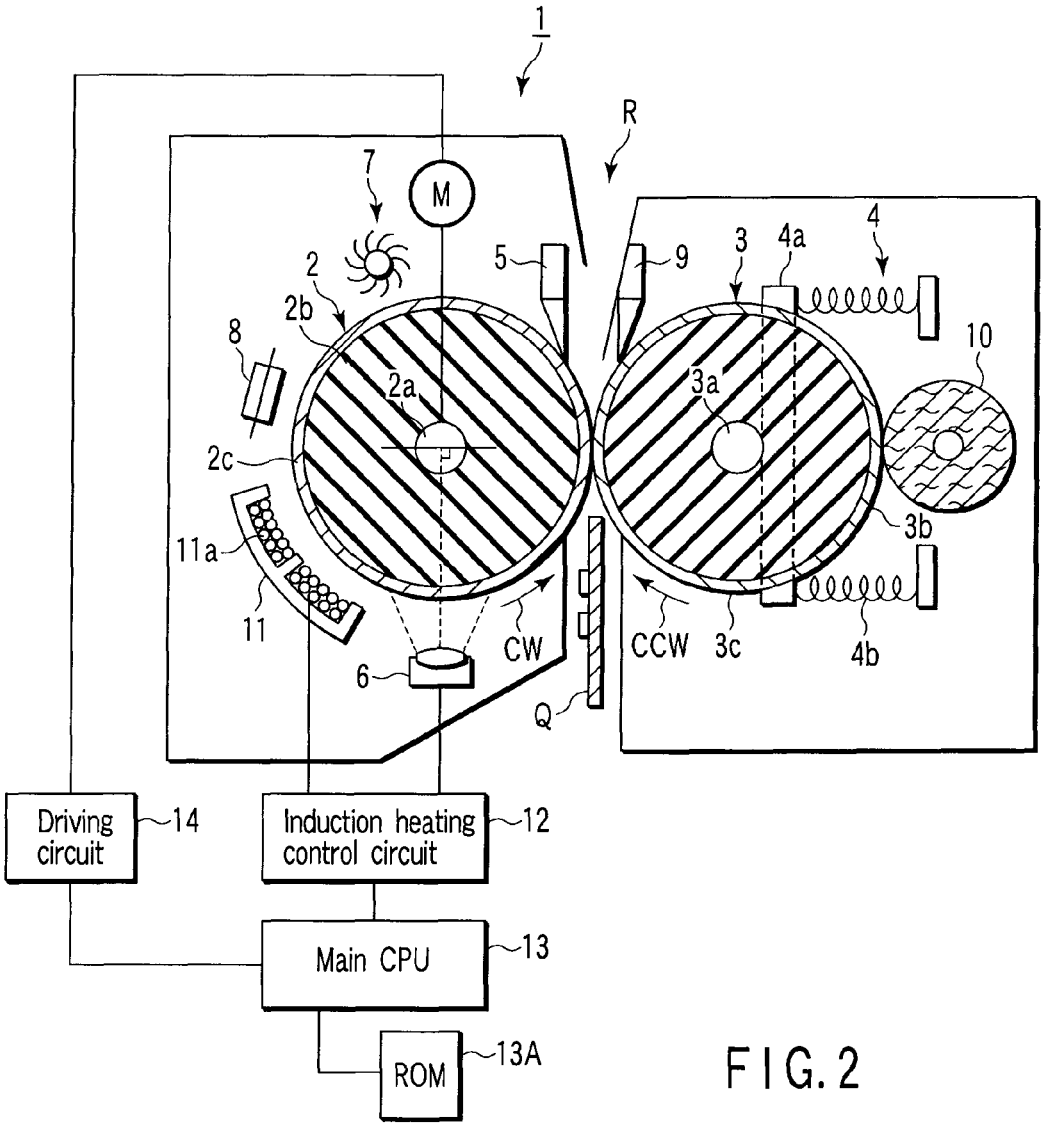
FIG. 2 is a schematic diagram showing an example of a fixing apparatus shown in FIG. 1.

FIG. 2 is a schematic diagram illustrating an example of the fixing apparatus used in the image forming apparatus shown in FIG. 1.

FIG. 2 is a schematic plan view illustrating an example of the fixing apparatus 1.

The fixing apparatus 1 has a heating roller 2, a pressurizing roller 3, a pressure mechanism 4, a releasing pawl 5, a temperature detecting element 6, a cleaning member 7, a heating error sensing element 8, a releasing pawl 9, a cleaning roller 10, an induction heating device 11, and an excitation coil 11*a*.

The heating roller 2 has a shaft member 2*a* fixed so as to be rotatable at a predetermined position in the fixing apparatus 1, an elastic member 2*b* placed around the shaft member 2*a*, and a metallic conductive layer 2*c*. The shaft member 2*a* is placed on the rotational center axis of the heating roller 2 and connected to a driving mechanism M to rotate in the direction of arrow CW. Although not shown, the heating roller 2 may comprise an elastic layer or a release layer around the outer periphery of the metallic conductive layer 2*c*.

The pressurizing roller 3 includes a shaft member 3*a*, an elastic member (for example, silicone rubber) 3*b* placed outside the shaft member 3*a*, and a release layer (for example, fluorine rubber) 3*c*. The pressurizing mechanism (pressure applying mechanism) 4 presses the pressurizing roller 3 against the heating roller 2 under the force of a pressurizing spring 4*b*, via a bearing member 4*a* connected to the shaft member 3*a*. This forms a nip portion in the contact portion between the heating roller 2 and the pressurizing roller 3, the nip portion has at least a given width (nip width) in the direction in which the sheet P is conveyed. The pressurizing roller 3 is rotated in the direction of arrow CCW in unison with rotation of the heating roller 2.

The releasing blade 5, the cleaning member 7, and the induction heating device 11 are provided, in this order, around the heating roller 2 downstream of the nip portion between the heating roller 2 and pressurizing roller 3 in the rotating direction; the releasing blade 5 releases the sheet Q from the heating roller 2, the cleaning member 7 removes offset toner, paper dust, or the like which adheres to the heating roller 2, and the induction heating device 11 includes the excitation coil 11*a* to apply a predetermined magnetic field to the metallic conductive layer 2*c* of the heating roller 2. The temperature detecting element 6 and the thermostat 8 are arranged in the longitudinal direction of the heating roller 2; the temperature detecting element 6 detects the temperature of the heating roller 2, and the thermostat 8 detects the abnormal surface temperature of the heating roller 2 to stop supplying power for heating the heating roller. A plurality of temperature detecting elements 6 are preferably provided in the longitudinal direction of the heating roller 2. At least one thermostat 8 is preferably provided in the longitudinal direction of the heating roller 2.

The releasing blade 9 and the cleaning member 10 are arranged around the pressurizing roller 3; the releasing blade 9 releases the sheet Q from the pressurizing roller 3, and the cleaning member 10 removes toner adhering to the pressurizing roller 3.

In the present embodiment, the elastic member 2*b* is composed of expanded rubber, for example, expanded silicone rubber. The metallic conductive layer 2*c* is composed of aluminum, nickel, iron, or the like which has a thickness of about 0.5 to 2 mm. The following configuration is available for an elastic and release layers (not shown) provided around the outer periphery of the metallic conductive layer 2*c* of the heating roller 2. For example, the elastic layer is composed of a heat resistant adhesive having a thickness of about several μm and containing silicon. The release layer is formed in the outermost part having a thickness of about 30 μm and composed of a fluorine resin (PFA, PTFE (poly tetrafluoroethylene), or a mixture of PFA and PTFE).

The temperature detecting element 6 is placed in an area located vertically below the rotational center axis (center axis of the shaft member 2*a*) of the heating roller 2 and vertically below the peripheral surface of the heating roller 2.

The induction heating device 11 is connected to an induction heating control circuit 12 connected to the temperature detecting element 6 and a main CPU 13. The main CPU 13 is connected to ROM (recording section, recording means) 13A to which temperature information detected by the temperature detecting element 6 and a driving circuit 14 that controls the driving mechanism M. The induction heating device 11 and induction heating control circuit 12 are collectively referred to as a heating device.

The main CPU 13 integrally controls fixing operations of the fixing apparatus 1.

Roller temperature information on the heating roller 2 detected by the temperature detecting element 6 is input to the induction heating control circuit 12. The induction heating control circuit 12 thus controllably supplies the coil 11*a* of the induction heating device 11 with a predetermined power based on this temperature information or the like. In other words, the induction heating control circuit 12 controllably raises the temperature of the heating roller 2 uniformly in its axial direction to a fixation temperature required for fixation on the basis of the roller temperature of the heating roller 2, output by the temperature detecting element 6.

A high-frequency current applied to the coil 11*a* of the induction heating device 11 by the induction heating control circuit 12 causes the coil 11*a* to generate a predetermined magnetic field to pass an eddy current through the metallic conductive layer 2*c* of the heating roller 2. Joule heating is then generated owing to the resistance of the metallic conductive layer 2*c* to heat the heating roller 2. That is to say, the heating roller 2 is induction heated by the induction heating device 6.

Toner T melted by heat from the heating roller 2 is then fixed to the sheet Q; the sheet Q to which the toner T is attached passes through the nip portion between the heating roller 2 and the pressurizing roller 3, where the pressurizing roller 3 exerts a predetermined pressure on the sheet Q.

The fixing apparatus of the present invention thus utilizes induction heating to heat the metallic conductive layer 2*c* formed around the outer peripheral surface of the heating roller 2. This reduces heat loss while improving energy efficiency to enable the temperature of the heating roller 2 to rise to a given value in a short time.

Figure 5:
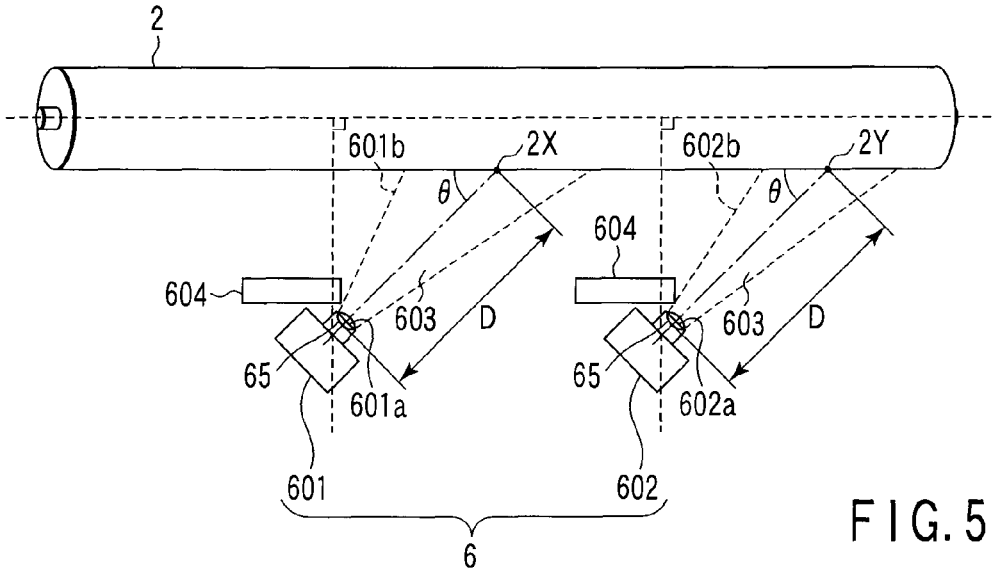
FIG. 5 is a schematic diagram showing the positional relationship between the temperature detection roller and a heating roller shown in FIG. 2.
Figure 3:
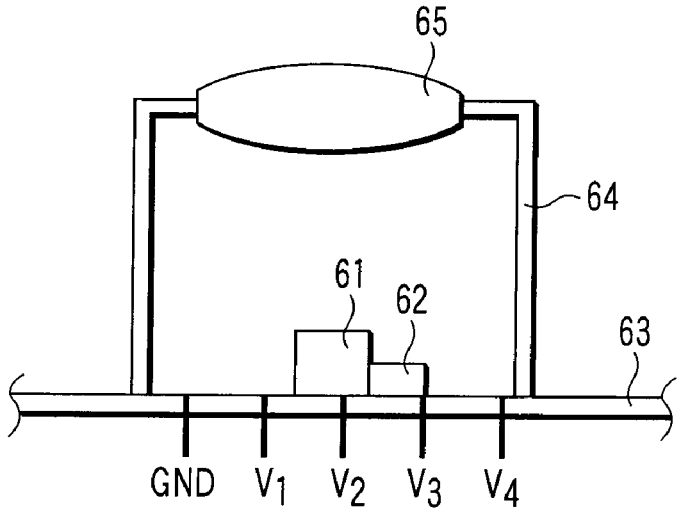
FIG. 3 is a schematic diagram showing an example of a temperature detecting element shown in FIG. 2.
Figure 4:
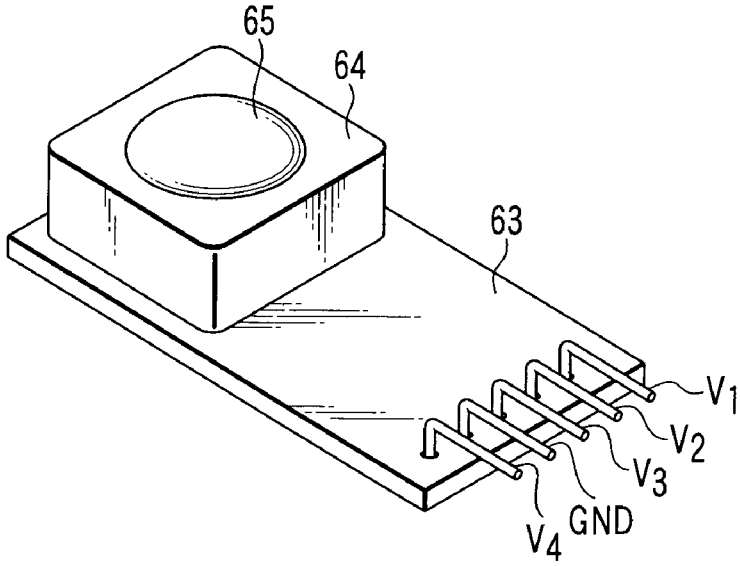
FIG. 4 is a schematic perspective view showing an example of the temperature detecting element shown in FIG. 2.

The configuration and position of the temperature detecting element 6 will be described with reference to FIGS. 2 to 5. FIG. 3 is a schematic sectional view of the temperature detecting element 6. FIG. 4 is a schematic perspective view of the temperature detecting element 6. FIG. 5 is a schematic diagram showing the positional relationship between the temperature detecting element 6 and the heating roller 2.

As shown in FIG. 3, the temperature detecting element 6 can detect the temperature of a target in a non-contact manner using infrared radiation. The temperature detecting element 6 includes a thermopile type temperature sensor (thermopile, first detecting section) 61 that detects a difference between the target temperature and the ambient temperature and a thermistor (second detecting section) 62 offering a resistance value varying depending on the ambient temperature in the vicinity of the thermopile 61.

The thermopile 61 and thermistor 62 are fixed to a substrate 63 and arranged in a space closed by a housing 64 as shown in FIGS. 3 and 4. The housing 64 has an infrared window portion from which detection surfaces of the thermopile 61 and thermistor 62 are exposed. The infrared window portion comprises an infrared transmitting member, for example, a condensing lens 65.

In the present embodiment, the thermopile 61 is composed of a thermocouple and includes a hot junction that receives infrared radiation to generate heat and a cold junction that does not generate heat in spite of infrared radiation. The thermopile 61 outputs the difference in temperature between the hot junction and the cold junction as a voltage. The thermistor 62 measures the temperature of the cold junction side, that is, the temperature of the thermopile 61.

As described below in detail, the temperature detecting element 6 comprises a connector V1 through which power is supplied to the thermopile 61 and thermistor 62, a connector V2 through which an output voltage from the thermistor 61 is output, a connector V3 through which an output voltage from the thermistor 62 is output, a connector V4 that detects connection errors in the temperature detecting element 6, and a ground GND to which the thermopile 61 and thermistor 62 are connected. A temperature detecting element connector 15 (see FIG. 6) is installed at a predetermined position in the fixing apparatus 1 and comprises a plurality of receiving portions paired with the connectors V1 to V4. Reliably inserting the temperature detecting element 6 into the temperature detecting element connector 15 ensures an electric connection between the connectors V1 to V4 and the plurality of receiving portions. In other words, connecting the connectors V1 to V4 and ground GND of the temperature detecting element 6 to the temperature detecting element connector 15 allows operating power from the image forming apparatus 10 to be supplied to the temperature detecting element 6. Temperature information detected by the thermopile 61 and thermistor 62 is thus output to the induction heating control circuit 12.

As shown in FIG. 4, the connectors V1 to V4 and ground GND are arranged in line on one side of the substrate 63. The connector V1 and V4 are positioned at the opposite ends of the set of the connectors.

As shown in FIG. 5, the temperature detecting element 6 includes a center temperature detecting element 601 that detects the temperature of a central portion of the heating roller 2, and a side temperature detecting element 602 that detects the temperature of an end of the heating roller 2.

The center temperature detecting element 601 includes a detection surface 601*a* that faces toward a measured position 2X on the outer periphery of the heating roller 2. The side temperature detecting element 602 includes a detection surface 602*a* that faces toward a measured position 2Y on the outer periphery of the heating roller 2. At the measured position 2X, the optical axis of the condensing lens 65 provided in the center temperature detecting element 601 crosses the outer peripheral surface of the heating roller 2. At the measured position 2Y, the optical axis of the condensing lens 65 provided in the side temperature detecting element 602 crosses the outer peripheral surface of the heating roller 2.

Both the center temperature detecting element 601 and the side temperature detecting element 602 are located vertically below the rotational axis of the heating roller 2. The center temperature detecting element 601 and temperature detecting element 602 are arranged so that the optical axes of the condensing lenses 65 provided on the detection surfaces 601*a* and 602*a* are inclined at a predetermined angle θ to the outer peripheral surface of the heating roller 2 in the axial direction of the roller 2, the outer peripheral surface including the measured positions 2X and 2Y on the heating roller 2. In other words, the center temperature detecting element 601 and side temperature detecting element 602 are installed so that their detection surfaces 601*a* and 602*a* face toward the heating roller 2 from obliquely below the heating roller 2. Further, in other words, the angle θ between the optical axis of the condensing lens 65 and the axial line of the heating roller 2 including the measured position 2X or 2Y is not 90°. The angle θ is that of the interface between the optical axis of the condensing lens 65 and the outer peripheral surface of heating roller 2 including the measured positions 2X and 2Y.

In the present embodiment, the center temperature detecting element 601 and side temperature detecting element 602 are fixed at positions such that the angle θ=45°.

Each of the center temperature detecting element 601 and side temperature detecting element 602 has a radially extending measurement range 603 and detects the dose of infrared radiation within the measurement range 603 to measure the target temperature. A hood member 604 is placed between the heating roller 2 and each of the center temperature detecting element 601 and side temperature detecting element 602 at a position where the hood member 604 does not significantly interfere with the measuring range 603. The hood member 604 prevents falling toner dust, oil, paper dust, or the like from falling onto the detection surfaces 601*a* and 602*a*.

The hood members 604 are arranged to cover the spaces located vertically above the center temperature detecting element 601 and side temperature detecting element 602. This enables the detection surfaces 601*a* and 602*a* to be protected from toner dust, oil, paper dust, or the like which flies from above the center temperature detecting element 601 and side temperature detecting element 602. The hood members 604 also enable a reduction in the amount of flying toner dust, oil, paper dust, or the like falling when the operation of the fixing apparatus 1 is stopped and adhering to the detection surfaces 601*a* and 602*a* of the temperature detecting element 6. The center temperature detecting element 601 and side temperature detecting element 602 can thus provide a dose of infrared radiation required to detect the target temperature, thus minimizing a detected temperature error.

In the present embodiment, the hood member 604 is shaped like sheet and is composed of a material having a transmittance of at least 20% for infrared radiation of wavelength 1 to 15 μm. In this case, even if for example, the hood member 604 partly overlaps and enters the measurement range 603 because of a manufacturing variation among temperature detecting elements 6, the rate of a decrease in the dose of infrared radiation can be reduced so as to avoid affecting detections by the temperature detecting element 6. This makes it possible to minimize temperature errors detected by center temperature detecting element 601 and side temperature detecting element 602.

The distance between each of the measurement positions 2X and 2Y on the heating roller 2 and the corresponding one of the detection surfaces 601*a* and 602*a* of the center temperature detecting element 601 and side temperature detecting element 602 is 40 mm. In other words, the spacing between each of the detection surfaces 601*a* and 602*a* of the center temperature detecting element 601 and side temperature detecting element 602 and the corresponding one of the measurement positions 2X and 2Y on the heating roller 2 is 40 mm on the optical axis of the condensing lens 65.

If the hood members 604 are composed of a material having a transmittance of at least 20% for infrared radiation having a wavelength of 1 to 15 μm, they may be arranged on the center temperature detecting element 601 and side temperature detecting element 602 so as to completely cover the spaces vertically above the temperature detecting elements. This enables a further reduction in toner dust, oil, paper dust, or the like adhering to the detection surfaces 601*a* and 602*a*.

The adverse effect of thermal convection on the temperature detecting element 6 can be reduced by placing the temperature detecting element 6 vertically below the rotational center axis of the heating roller 2 and below the peripheral surface of the heating roller 2 as described above. This prevents the situation in which heat from the heating roller 2 heated by the induction heating device 11 results in thermal convection to cause a hot air current to flow vertically upward to rapidly change the temperature of the temperature detecting element 6. That is to say, the area below the heating roller 2 is more unlikely to be affected by the thermal convection than the area above the heating roller 2. Placing the temperature detecting element 6 below the heating roller 2 prevents a rapid change in the temperature detected by the thermistor 62 or the cold junction of the thermopile 61, the change being caused by the thermal convection. This enables a reduction in the adverse effect of the thermal convection on the temperature detecting element 6. Consequently, errors in the temperature detected by the temperature detecting element 6 can be minimized to prevent the following situation: a temperature lower than the target one is erroneously detected, so that the heating roller 2 is mistakenly heated on the basis of output information from the temperature detecting element 6, or a temperature higher than the target one is mistakenly detected, so that the temperature of the heating roller 2 decreases below the fixation temperature during a fixing operation. This enables a reduction in power consumption involved in excessive heating. The adverse effect of the power consumption on manufacture costs and efficiency can thus be minimized to improve productivity. This configuration also avoids inappropriate images resulting from a fixing operation at a temperature lower than the fixation temperature, thus enabling images to be appropriately formed.

Second Embodiment

Now, with reference to FIG. 6, description will be given of an internal wiring circuit that is applicable to the temperature detecting element 6.

Figure 6:
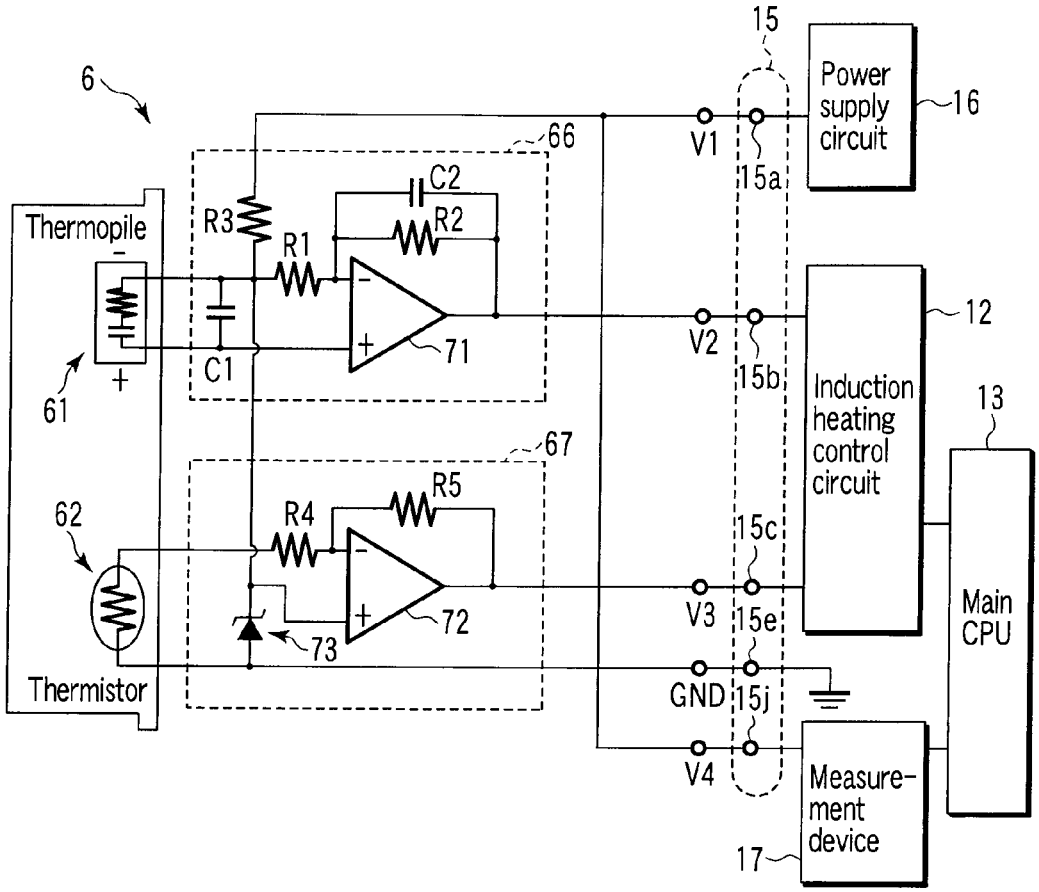
FIG. 6 is a diagram showing an example of an internal wiring circuit that is applicable to the temperature detecting element shown in FIG. 2.

As shown in FIG. 6, the temperature detecting element 6 includes a thermopile 61, a thermistor 62, operational amplifiers 71 and 72, a Zener diode 73, resistors R1 to R5, and capacitors C1 and C2.

The thermopile (first detecting section) 61 is connected to a connector (first terminal) V1 and a first amplifying section 66. Power from the connector V1 is input to the thermopile 61, which outputs a thermopile output voltage to the first amplifying section 66. The first amplifying section 66 amplifies the input thermopile output voltage and outputs the amplified thermopile output voltage (first detected value) through a connector (second terminal) V2 as detected temperature information from the thermopile 61.

The thermistor (second detecting section) 62 is connected to the connector V1 and second amplifying section 67. The thermistor 62 is supplied with power from the connector V1 to output a thermistor output voltage to the second amplifying section 67. The second amplifying section 67 amplifies the input thermistor output voltage to output the amplified thermistor output voltage (second detection value) through a connector (third terminal) V3 as temperature information detected by the thermistor 62.

The connector V1 is supplied with power required to operate the temperature detecting element 6. In the present embodiment, a 5-V voltage is supplied through the connector V1, which is also connected to a connector (fourth terminal) V4 before reaching the first amplifying section 66. In other words, the temperature detecting element 6, reliably electrically connected to the temperature detecting element connector 15, forms an electric line through which power input through the connector V1 is returned to the image forming apparatus via the connector V4.

The connectors V1 to V4 and ground GND are electrically connected to the image forming apparatus 101 via the temperature detecting element connector 15. Specifically, the temperature detecting element connector 15 includes a plurality of receiving portions 15*a*, 15*b*, 15*c*, 15*d*, and 15*e* corresponding to the connectors V1 to V4 and ground GND, respectively. The receiving portions 15*a* to 15*e* are connected to the induction heating control device 12, main CPU 13, power supply circuit 16, and measurement device 17, provided in the image forming apparatus 101.

The connector V1 is electrically connected to the receiving portion 15*a* of the temperature detecting element connector 15 and then to the power supply circuit 16. The connectors V2 and V3 are electrically connected to the receiving portions 15*b* and 15*c*, respectively, of the temperature detecting element connector 15 and then to the induction heating control circuit 12. The connector V4 is electrically connected to the receiving portion 15*d* of the temperature detecting element connector 15 and then to the measurement device 17. The ground GND is electrically connected to the receiving portion 15*e* of the temperature detecting element connector 15 and then to a ground provided in the image forming apparatus 101 side.

The power supply circuit 16 supplies power required to operate the image forming apparatus 101 and fixing apparatus 1.

The measurement device 17 is connected to the main CPU 13, shown in FIG. 2, and measures a voltage output through the connector V4 to output the value obtained to the main CPU 13.

The main CPU 13 can check the electric connection between the temperature detecting element 6 and the temperature detecting element connector 15 on the basis of the voltage detected by the measurement device 17.

The connector V4 outputs the voltage of 5 V supplied through the connector V1, if at least the connectors V1 and V4 are electrically connected to the appropriate receiving portions of the temperature detecting element connector 15. Since the connectors V1 and V4 are arranged at the opposite ends of the set of the plurality of terminals provided in the temperature detecting element 6, if these connectors are appropriately connected, then the connectors V2 and V3 and ground GND are electrically connected to the temperature detecting element connector 15.

Accordingly, while the measurement device 17 is measuring a voltage of 5 V, which is the same as the voltage supplied to the connector V1, the main CPU 13 instructs the fixing apparatus 1 to perform a fixing operation, for example, instructs the induction heating control circuit 12 to heat the heating roller 2 and the driving circuit 14 to rotate the heating roller 2.

On the other hand, if the connector V1 or V4 is not electrically connected to the temperature detecting element connector 15, the measurement device 17 cannot output the voltage of 5 V supplied through the connector V1. In this case, the main CPU 13 performs such control as stops the fixing operation, for example, causes the induction heating control circuit 12 to stop heating the heating roller 2 and causes the driving circuit 14 to stop rotating the heating roller 2.

Thus, if the measurement device 17 outputs the same voltage as that supplied to the connector V1, the main CPU 13 can determine that the temperature detecting element 6 is reliably electrically connected to the temperature detecting element connector 15. On the other hand, if the same voltage as that supplied to the connector V1 is not supplied, the main CPU 13 can determine that the electric connection between the temperature detecting elements 6 and 15 has not been established. That is to say, the main CPU 13 can check the electric connection of the temperature detecting element 6 by comparing the voltage measured by the measurement device 17 with the voltage supplied to the connector V1 by the power supply circuit 16.

This enables the detection of an incomplete connection between the temperature connecting element 6 and the temperature detecting element connector 15 resulting from, for example, oblique insertion of the temperature detecting element 6 into the temperature detecting element connector 15. It is also possible to detect the temperature detecting element 6 having slipped out of the temperature detecting element connector 15 as a result of vibration or the like.

This configuration thus makes it possible to prevent overheating of the heating roller 2 or a decrease in the temperature of the heating roller 2 below the fixation temperature as a result of the erroneous determination of the target temperature owing to the failure to establish the electric connection between the temperature detecting element 6 and the temperature detecting element connector 15. This enables a reduction in power consumption involved in excessive heating. The adverse effect of the power consumption on manufacture costs and efficiency can thus be minimized to improve productivity. This configuration also avoids inappropriate images resulting from a fixing operation at a temperature lower than the fixation temperature, thus enabling images to be appropriately formed.

The connectors V1 and V4 are arranged at the opposite ends of the set of the plurality of connector terminals provided in the temperature detecting element 6. This enables the detection of oblique installation of the temperature detecting element 6. This in turn makes it possible to increase the accuracy of detection of errors in the temperature detecting element 6 such as an inappropriate connection resulting from unstable installation.

In the description of the present embodiment, the power supplied through the connector V1 is 5 V. However, the present invention is not limited to this. Arbitrary power corresponding to the temperature detecting element 6 may be supplied. Further, in the description of the present embodiment, the main CPU 13 compares the voltage measured by the measurement device 17 with the voltage of 5 V supplied to the connector V1 to determine whether or not the voltage (5 V) determined by the measurement device 17 has been detected. However, the present invention is not limited to this. The main CPU 13 may determine whether or not a value similar to 5 V has been detected by the measurement device 17. In other words, the main CPU 13 may controllably stop the heating device if the power output by the measurement device 17 is lower than that supplied to the connector V1, by a predetermined value (for example, 0.5 V).

Third Embodiment

Now, with reference to FIGS. 7 to 10, description will be given of a temperature detection method that is applicable to the fixing apparatus 1.

First, with reference to FIGS. 7 to 9, description will be given of tests for calculating parameters for an induction heating control method that is applicable to the present embodiment.

Figure 7:
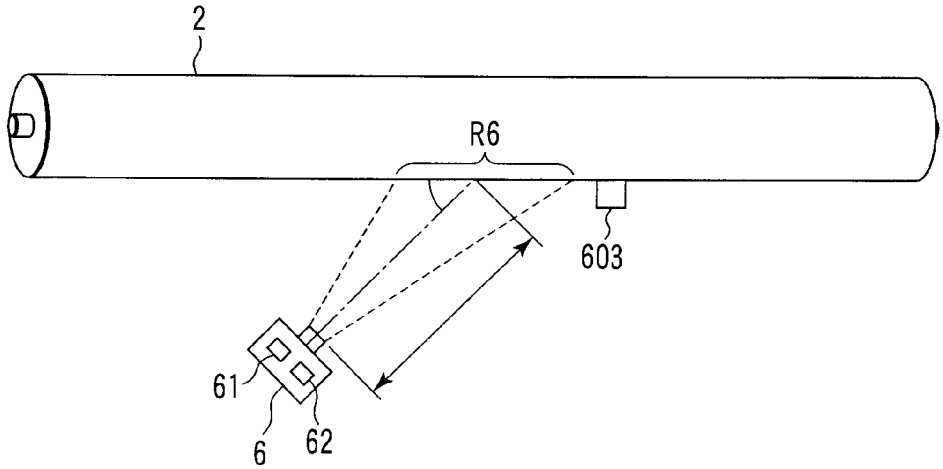
FIG. 7 is a diagram illustrating tests for calculating a correction value for an induction heating control method that is applicable to the fixing apparatus shown in FIG. 2.

FIG. 7 is a schematic diagram illustrating a fixing apparatus used for the tests. FIG. 8 is a diagram showing the relationship between the self temperature of the temperature detecting element 6 and an error in the temperature detected by the temperature detecting element 6. FIG. 9 is a diagram showing the relationship between the slope of self temperature detected value of the temperature detecting element 6 and an error in the temperature detected by the temperature detecting element 6.

As shown in FIG. 7, the fixing apparatus used for the tests comprises the temperature detecting element 6 that detects the temperature of outer peripheral surface of the heating roller 2. As described above, the temperature detecting element 6 is placed in an area located vertically below the rotational center axis of the heating roller 2 and vertically below the peripheral surface of the heating roller 2. The temperature detecting element 6 includes the thermopile 61 that detects a difference between the target temperature and the atmospheric temperature and a thermistor 62 that detects the self temperature of the temperature detecting element 6 on the basis of a variation in resistance value which corresponds to a variation in the atmospheric temperature in the vicinity of the thermopile 61. The thermopile 61 detects a temperature within a measurement range R6. A thermocouple 603 is placed near the measurement range R6 to detect the temperature of the heating roller 2 in the vicinity of the measurement range R6.

The thus configured fixing apparatus uses the above induction heating device to heat the heating roller 2. The temperature detecting element 6 detects a temperature T1, the thermocouple 603 detects a temperature T2, and the thermistor 62 of the temperature detecting element 6 detects a temperature T3.

The tests involve calculating the difference (T2−T1) between the temperature T1 from the temperature detecting element 6 and the temperature T2 from the thermocouple 603, that is, an error T4 in the temperature detected by the temperature detecting element 6. The slope S5 of the error T4 is then determined on the basis of the temperature T3 detected by the thermistor 62 of the temperature detecting element 6. The slope S5 indicates the amount of variation in the temperature detected by the thermistor 6 during 10 seconds. FIG. 8 is a diagram showing the relationship between the temperature T3 detected by the thermistor 62 in the temperature detecting element 6 and the error T4 in the temperature detected by the temperature detecting element 6.

Figure 8:
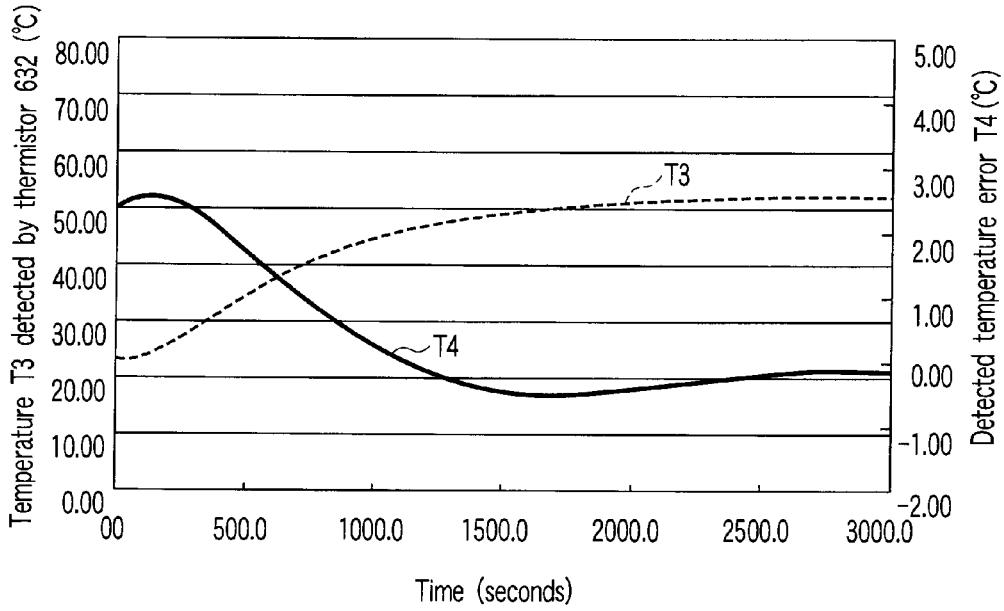
FIG. 8 is a diagram showing the relationship between the self temperature of the temperature detecting element and an error in a temperature detected by the temperature detecting element in connection with the tests.

As shown in FIG. 8, the detected temperature error T4 is large when the temperature T3 detected by the thermistor 62 varies significantly (between 0 and about 1,300 seconds). Specifically, the detected temperature error T4 is largest when the temperature T3 detected by the thermistor 62 starts to rise, and becomes stable when the temperature T3 detected by the thermistor 62 starts to be stabilized. That is, when the temperature T3 detected by the thermistor 62 starts to rise, the error in the temperature detected by the temperature detecting element 6 is largest, and a temperature lower than the actual one is detected.

Figure 9:
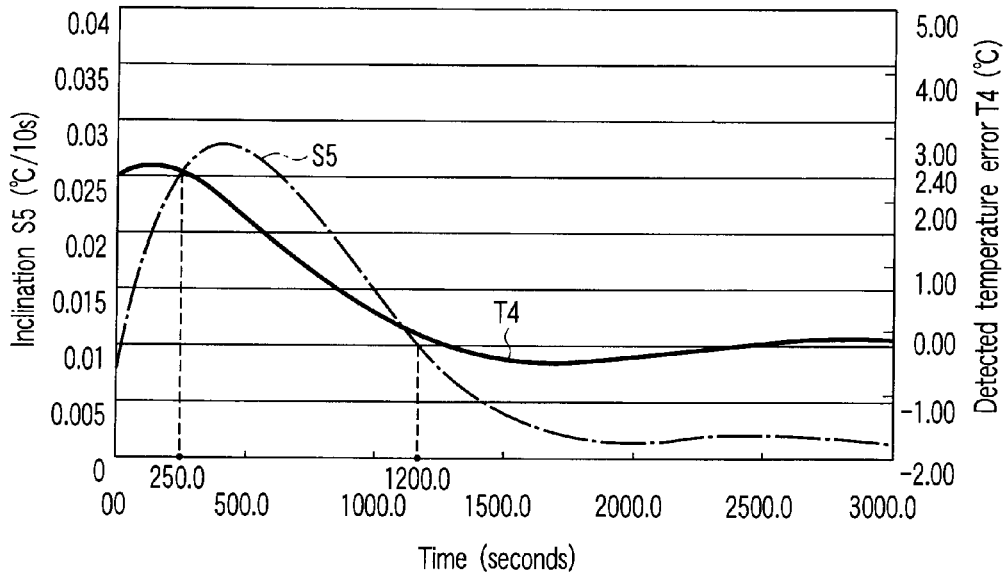
FIG. 9 is a diagram showing the relationship between the slope of detected value of the self temperature of the temperature detecting element and the error in the temperature detected by the temperature detecting element.

FIG. 9 is a diagram showing the relationship between the error 4 in the temperature detected by the temperature detecting element 6 and the slope S5.

As shown in FIG. 9, the slope S5 is large when the detected temperature error T4 varies significantly (between 0 and about 1,300 seconds). Specifically, the detected temperature error T4 is about 2.4° C. when the time=0 second, and then increases to the maximum value=about 2.7° C. The error T4 then decreases back to about 2.4° C. In the meantime, the slope S5 increases rapidly from about 0.006 to 0.025 (° C./10 s). The detected temperature error T4 subsequently gradually approaches zero. When the slope S5 is 0.01 (° C./10 s) or smaller, the detected temperature error becomes almost zero, an error that does not substantially affect the induction heating control of the heating roller 2. This variation requires about 1,200.0 seconds.

Such a temperature error may occur when the outer cover 201 of the image forming apparatus 101 is opened owing to, for example, paper jam, with a resultant rapidly change in the temperature in the fixing apparatus 1. In this case, the temperature T3 detected by the thermistor 62 varies sharply, and the temperature detecting element 6 detects a temperature lower than the actual one. As a result, the heating roller 2 may be heated to a temperature higher than a set one, leading to inappropriate fixation or degraded image quality.

The induction heating control method according to the present invention thus applies a correction value to the temperature detected by the temperature detecting element 6 on the basis of the value of the slope S5, indicating the amount of variation in the temperature T3 detected by the thermistor 62 during 10 seconds. This minimizes the error T4 in the temperature detected by the temperature detecting element 6.

Figure 10:
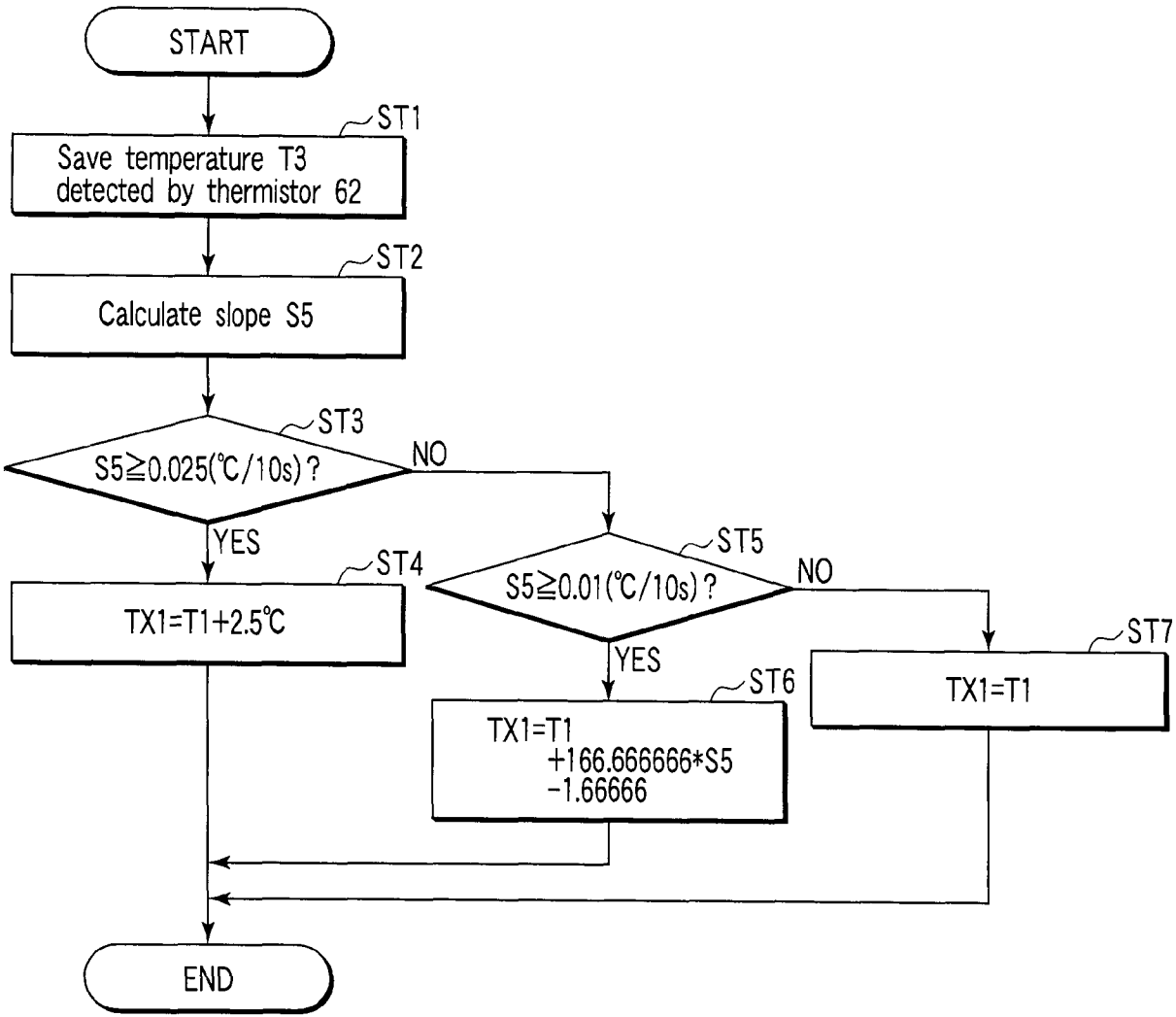
FIG. 10 is a flowchart illustrating an example of an induction heating control method that is applicable to the fixing apparatus shown in FIG. 2.

With reference to FIG. 10, description will be given of induction heating control that is applicable to the fixing apparatus 1.

As shown in FIG. 10, the main CPU 13 starts the induction heating of the heating roller 2. The main CPU 13 saves, to ROM 13A, the temperature T3 detected every 10 seconds by the thermistor 62 of the temperature detecting element 6 (ST1). The main CPU 13 calculates the slope S5 on the basis of the saved temperature T3 (ST2) to determine whether or not the value of the slope S5 is at least a first specified value of 0.025 (ST3). If the value of the slope S5 is at least the first specified value of 0.025 (ST3—YES), the main CPU 13 adds a correction value of 2.5° C. to the temperature (third detected value) T1 detected by the temperature detecting value 6 to obtain a temperature TX1. The main CPU 13 then outputs the temperature TX1 to the induction heating control circuit 12 as temperature information detected by the temperature detecting element 6 (ST4).

If the value of the slope S5 is smaller than the first specified value of 0.025 (ST3—NO), the main CPU 13 determines whether or not the value of the slope S5 is at least a second specified value of 0.01 (ST5). If the value of the slope S5 is at least the second specified value of 0.01 (ST5—YES), the main CPU 13 adds a second correction value of 166.66666× S5−1.66666 to the temperature (third detected value) T1 detected by the temperature detecting element 6 to obtain a temperature TX1. The main CPU 13 then outputs the temperature TX1 to the induction heating control circuit 12 as temperature information detected by the temperature detecting element 6 (ST6).

If the value of the slope S5 is smaller than the second specified value of 0.01 (ST5—NO), the main CPU 13 outputs the temperature T1 to the induction heating control circuit 12 without adding a correction value to the temperature T1 detected by the temperature detecting element 6 (ST7).

On the basis of the temperature information TX1 from the temperature detecting element 6, output by the main CPU 13, the induction heating control circuit 12 controls the induction heating device 11 to heat the heating roller 2 to the fixation temperature.

The main CPU 13 can thus obtain temperature detection information with a detection error in the temperature detecting element 6 corrected. Accordingly, even if the atmospheric temperature in the fixing apparatus 1 changes rapidly, the temperature T1 detected by the temperature detecting element 6 can be made closer to the actual temperature. The heating roller 2 can thus be heated to the fixation temperature, thus enabling high-quality images to be formed.

The present invention is not limited to the above embodiments proper. In implementation, the components of the embodiments may be varied without departing from the spirit of the present invention. Various inventions can be formed by appropriately combining a plurality of components disclosed in the above embodiments. For example, some of the components shown in the embodiments may be deleted. Moreover, components from different embodiments may be appropriately combined together.

For example, in the above description, the heating roller 2 is induction heated by the induction heating control circuit 12. However, the present invention is not limited to this. The heating roller 2 may be heated by infrared radiation from a lamp or the like.

What is claimed is:

1. A fixing apparatus comprising:

a heating member having an outer peripheral surface which is heated;

a temperature detecting member, located vertically below and not in contact with the heating member, and including a detection surface which is inclined at a predetermined angle to the outer peripheral surface of the heating member and which receives infrared radiation from the heating member, to detect a temperature of the outer peripheral surface of the heating member on the basis of the received infrared radiation; and a heating device which heats the heating member to a target temperature on the basis of the temperature detected by the temperature detecting member.

2. The apparatus of claim 1, wherein the temperature detecting member include a lens which condenses the infrared radiation from the outer peripheral surface of the heating member.

3. The apparatus of claim 2, wherein an optical axis of the lens is inclined at a predetermined angle to the outer peripheral surface of the heating member including a point where the optical axis of the lens crosses a surface located in the outer peripheral surface of the heating member.

4. The apparatus of claim 2, wherein the temperature detecting member is provided so that an optical axis of the lens is inclined at 45° to the outer peripheral surface of the heating member.

5. The apparatus of claim 3, wherein the temperature detecting member is provided so that the optical axis of the lens is inclined at 45° to the outer peripheral surface of the heating member.

6. The apparatus of claim 1, wherein the temperature detecting member includes a first detecting section which receives from the detection surface the infrared radiation from the outer peripheral surface of the heating member and detects the temperature of outer peripheral surface of the heating member, a second detecting section which detects the atmospheric temperature of periphery of the first detecting section, a first terminal through which power is supplied to at least one of the first detecting section and the second detecting section, a second terminal through which a detected value detected by the first detecting section is output, a third terminal through which a detected value detected by the second detecting section is output, and a fourth terminal connected to between the first terminal and the first or second detecting section and provided at a position farther from the first terminal than from the second and third terminals.

7. The apparatus of claim 1, further comprising a hood member placed between the heating member and the temperature detecting member to block a falling object falling onto the detection surface of the temperature detecting member to protect the detection surface from contamination.

8. The apparatus of claim 7, wherein the hood member comprises a material having a transmittance of at least 20% for infrared radiation of wavelength 1 to 15 μm.

9. The apparatus of claim 2, wherein a spacing between the detection surface of the temperature detecting member and the heating member is 20 mm or more on an optical axis of the lens.

10. A method for controlling the temperature of the outer peripheral surface of the heating member in the fixing apparatus claimed in claim 1, comprising:

detecting a temperature of the outer peripheral surface of the heating member on the basis of the received infrared radiation;

detecting a temperature of an atmospheric temperature; and stopping the power supplied to a heating element in accordance with the detecting result of difference between the temperature of an outer peripheral surface and the temperature of an atmospheric temperature.

11. An image forming apparatus comprising:

an image carrier which electrostatically holds a development image;

a transfer device which transfers the development image from the image carrier to transfer media;

a heating member having an outer peripheral surface which is heated;

a temperature detecting member located vertically below and not in contact with the heating member, and including a detection surface which is inclined at a predetermined angle to the outer peripheral surface of the heating member and which receives infrared radiation from the heating member to detect a temperature of the outer peripheral surface of the heating member on the basis of the received infrared radiation;

a heating device which heats the heating member to a target temperature on the basis of the temperature detected by the temperature detecting member;

a pressurizing member which exerts a predetermined pressure on the heating member to melt and contact the development image with the transfer media under pressure, the transfer media passing between the pressuring member and the heating member; and a control section connected to the image carrier, the transfer device, and the heating device to integrally control the image carrier, transfer device, and heating device.

12. The apparatus of claim 11, wherein the temperature detecting member include a lens which condenses the infrared radiation from the outer peripheral surface of the heating member.

13. The apparatus of claim 12, wherein an optical axis of the lens is inclined at a predetermined angle to the outer peripheral surface of the heating member including a point where the optical axis of the lens crosses a surface located in the outer peripheral surface of the heating member.

14. The apparatus of claim 12, wherein the temperature detecting member is provided so that an optical axis of the lens is inclined at 45° to the outer peripheral surface of the heating member.

15. The apparatus of claim 13, wherein the temperature detecting member is provided so that the optical axis of the lens is inclined at 45° to the outer peripheral surface of the heating member.

16. The apparatus of claim 11, wherein the temperature detecting member includes a first detecting section which receives from the detection surface the infrared radiation from the outer peripheral surface of the heating member and detects the temperature of outer peripheral surface of the heating member, a second detecting section which detects the atmospheric temperature of periphery of the first detecting section, a first terminal through which power is supplied to at least one of the first detecting section and the second detecting section, a second terminal through which a detected value detected by the first detecting section is output, a third terminal through which a detected value detected by the second detecting section is output, and a fourth terminal connected to between the first terminal and the first or second detecting section and provided at a position farther from the first terminal than from the second and third terminals.

17. The apparatus of claim 11, further comprising a hood member placed between the heating member and the temperature detecting member to block a falling object falling onto the detection surface of the temperature detecting member to protect the detection surface from contamination.

18. The apparatus of claim 17, wherein the hood member comprises a material having a transmittance of at least 20% for infrared radiation of wavelength 1 to 15 μm.

19. The apparatus of claim 12, wherein a spacing between the detection surface of the temperature detecting member and the heating member is 20 mm or more on an optical axis of the lens.

* * * * *